United States Patent [19]

Miura et al.

[11] Patent Number: 5,055,320

[45] Date of Patent: Oct. 8, 1991

[54] PROCESS FOR THE PREPARATION OF SUPPORT SHEET FOR PHOTOGRAPHIC PRINTING PAPER AND RESULTING ARTICLE

[75] Inventors: Takaharu Miura, Chiba; Tsunehisa Shigetani, Tokyo; Minoru Moriki, Yokohama, all of Japan

[73] Assignee: Oji Paper Co., Ltd., Tokyo, Japan

[21] Appl. No.: 450,508

[22] Filed: Dec. 14, 1989

[30] Foreign Application Priority Data

Jan. 19, 1989 [JP] Japan ..... 1-8630

[51] Int. Cl.[5] ..... B05D 3/06

[52] U.S. Cl. ..... 427/40; 427/38; 427/41; 427/209; 427/223; 427/322; 427/340; 428/342; 428/512; 430/532; 430/539; 430/937

[58] Field of Search ..... 427/37-39, 427/209, 423, 40, 41, 223, 322, 340; 428/342, 512; 430/532, 539, 937

[56] References Cited

U.S. PATENT DOCUMENTS 4,451,497 5/1984 Dolezalek ..... 427/39

*Primary Examiner*—Pianalto Bernard

*Attorney, Agent, or Firm*—Armstrong, Nikaido, Marmelstein, Kubovcik & Murray

[57] ABSTRACT

A support sheet for photographic printing paper having an undercoat layer on which a photographic emulsion layer is to be formed, and which is free from foaming, contamination by foreign substances, and putrefaction and does not effect the photographic emulsion, by the steps of coating front and back surfaces of a substrate sheet with polyolefin resins; surface-activating the front coating layer; and extrusion coating the activated surface of the front coating layer with a coating liquid comprising gelatin, through a slit-shaped orifice, to form the undercoat layer.

16 Claims, 1 Drawing Sheet

PROCESS FOR THE PREPARATION OF SUPPORT SHEET FOR PHOTOGRAPHIC PRINTING PAPER AND RESULTING ARTICLE

BACKGROUND OF THE INVENTION

1.) Field of the Invention

The present invention relates to a process for the preparation of a support sheet for a photographic printing paper. More particularly, the present invention relates to a process for the preparation of a support sheet which can be coated with a photographic emulsion layer and display an excellent bonding property without fogging, and thus is useful for producing photographic printing paper having a uniform photographic image-forming property.

2.) Description of the Related Arts

Conventionally, Support sheets produced by coating a surface of a substrate paper sheet having a high size fastness and a high mechanical strength with a white pigment, for example, barium sulfate, i.e., baryta paper sheets, are employed as support sheets for photographic printing paper. Recently, however, the baryta paper sheet has been replaced by a polyolefin-coated support sheet produced by coating both surfaces of a substrate paper sheet with a polyolefin resin. This wide-spread use of the polyolefin-coated support sheet is due to the advantages thereof when compared to the conventional baryta paper sheet. Namely, since the polyolefin is hydrophobic, when a photographic paper sheet is subjected to usual developing and fixing procedures, the polyolefin coated support sheet in the photographic paper sheet is highly resistant to a permeation therein of the developing and fixing solutions, and therefore, the water-washing time and drying time for the treated photographic paper sheet can be significantly shortened, and further, since a permeation of the treating solutions into the polyolefin-coated support sheet cannot occur, the dimensional changes (shrinkage and elongation) of the substrate sheet are significantly reduced, and therefore, the photographic paper sheet can exhibit an excellent dimensional stability.

Nevertheless, the water-proof photographic paper sheet is disadvantageous in that, since the surface of the polyolefin coating layer formed on the substrate sheet is hydrophobic, it is difficult to firmly bond a photographic emulsion layer to the hydrophobic polyolefin coating layer surface through a hydrophilic binder layer comprised of gelatin.

To eliminate this difficulty, a method has recently been adopted in which the hydrophobic polyolefin coating layer surface is activated by applying a corona discharge treatment, flame treatment or chemical treatment thereon, and the activated surface is then coated with the photographic emulsion layer.

Nevertheless, if the surface of the polyolefin coating layer is activated by the above-mentioned treatment, undesirable fogging of the photographic emulsion layer sometimes occurs or the coating thickness of the emulsion layer becomes uneven and the thickness increases at the coating-initiating line. Moreover, the activity of the surface of the polyolefin coating layer obtained by this activation method is reduced with the lapse of time, and therefore, where the photographic emulsion is coated after a long time has passed since the activation treatment, the wettability and adhesiveness of the emulsion layer become poor and the emulsion layer is easily peeled from the surface of the polyolefin coating layer.

To overcome these disadvantages, a method has been adopted in which, after the surface of the polyolefin coating layer is once subjected to the activation treatment, an undercoat layer is formed on the activated surface and the photographic emulsion is coated on the undercoat layer. As the main constituent of the undercoat layer used in this method, there are known (1) gelatin or a composition comprising gelatin as the main component and (2) a composition comprising a hydrophilic resin other than gelatin as the main component.

As the composition (2), latexes of various water-insoluble resins and aqueous solutions of various water-soluble resins have been investigated and it has been found that, when the composition (2) is used, although the low-temperature coagulating step after the coating step need not be carried out, the resultant undercoat layer generally exhibits a poor adhesion to a photographic emulsion layer, and a poisonous gas is generated when some types of resins are used, having an adverse influence on the human body or causing environmental pollution.

When a photographic emulsion layer is formed on the undercoat layer, some types of undercoat layers have an adverse influence on the photographic characteristics, for example, cause fogging of and/or reduce the coating uniformity of the photographic emulsion layer. In this case, it is difficult to select an appropriate composition to be used for the undercoat layer.

In contrast, where the composition (1) comprising gelatin as the main component is used, the formed undercoat layer shows an excellent wettability and adhesiveness and these effects are long-lasting, and the undercoat layer does not have an adverse influence on a photographic emulsion. Accordingly, this type of undercoat layer is widely used.

Where an undercoat layer is formed by using the composition comprising gelatin as the main component, a gelatin-containing coating liquid comprising water as the main solvent is ordinarily used while circulating the coating liquid between a coating apparatus and a storing equipment.

During this circulation, the coating liquid is stirred by an agitator or a pick-up roll in an open system, and excess coating liquid in the coating liquid layer applied in an amount exceeding the necessary amount is scraped off by using a Meyer bar or a blade, or is blown off by an air knife, and is then recovered. Accordingly, air bubbles are inevitably formed in, and violent bubbling also occurs in the coating liquid. Air bubbles in the gelatin coating liquid cause coating unevenness, and when a photographic emulsion is coated on the resultant undercoat layer, an adverse influence is exerted on the coating-initiating line, or coating unevenness occurs in the emulsion layer, and an adverse influence is exerted on the adhesion between the undercoat layer and the emulsion layer.

Accordingly, an anti-foaming agent is usually added to the coating liquid, but the anti-foaming agent forms small pores on the surface of the coating layer when the coating liquid is applied, and such small pores cause a repelling phenomenon, prolongation of the coating-initiating line, or have an adverse influence on the photographic characteristics of the photographic emulsion layer. Accordingly, the use of the anti-foaming agent is restricted. Furthermore, although a defoaming apparatus for removing air bubbles is used, satisfactory effects can not be obtained.

Moreover, where the coating liquid is circulated in the above-mentioned manner, the coating liquid is circulated through a system open to the air, and materials or bacteria floating in the air drop into and are mixed with the coating liquid, and cause defects in the undercoat layer and putrefaction of the coating liquid with a lapse of time. Accordingly, when forming the undercoat layer, a method of preventing contamination by foreign substances in the coating liquid should be taken into consideration. Moreover, an antiseptic effect must be obtained by adding an antiseptic agent or the like.

When the method customarily adopted, for example, the Meyer bar coating method, the blade coating method or the comma coating method is used for coating the undercoat layer-forming coating liquid, sometimes fine coating streaks are formed by the shearing force imposed on the coating liquid. Moreover, where the gravure coating method is adopted, when the gravure roll is separated from the coated surface, coating unevenness in a peculiar pattern is caused. Furthermore, when the air knife coating method is adopted, coating in a peculiar pattern unevenness is often caused by blowing off an excess amount of coating liquid. Therefore, when a photographic emulsion is coated on the undercoat layer formed by any of the above-mentioned conventional methods, many problems or disadvantages are incurred.

SUMMARY OF THE INVENTION

An object of the present invention is to provide a process for the preparation of a support sheet for photographic printing paper, in which process an undesirable contamination of an undercoat layer-forming coating liquid by air bubbles is prevented.

Another object of the present invention is to provide a process for the preparation of a support sheet for photographic printing paper, in which process the resultant undercoat layer is free from the disadvantages of, for example, a repelling of the liquid and contamination by foreign matters.

Still another object of the present invention is to provide a process for the preparation of a support sheet, for photographic printing paper, having an undercoat layer on which a photographic emulsion layer is directly coated, which undercoat layer exhibits a good storage stability without an adverse influence on the photographic characteristics of a photographic emulsion layer.

A further object of the present invention is to provide a process for the preparation of a support sheet, for photographic printing paper, having an undercoat layer which does not have an adverse influence on the coating-initiating line when a photographic emulsion is coated thereon.

A still further object of the present invention is to provide a process for the preparation of a support for a photographic printing paper, which process comprises the step of coating an undercoat layer-forming liquid in which putrefaction of the coating liquid does not occur even upon storage for a long time.

The above-mentioned objects can be attained by the process of the present invention, which comprises the steps of coating each of front and back surfaces of a substrate sheet with a resinous material comprising, as a principal component, a polyolefin resin, to form front and back coating resin layers thereon; applying a surface-activation treatment to the front coating resin layer on the surface of which a photographic emulsion layer is to be formed, and coating the activated surface of the front coating resin layer with a coating liquid comprising, as a principal component, gelatin, by extruding the coating liquid through a slit-shaped orifice to form an undercoat layer for the photographic emulsion.

DESCRIPTION OF THE REFERRED EMBODIMENTS

Figure 1:
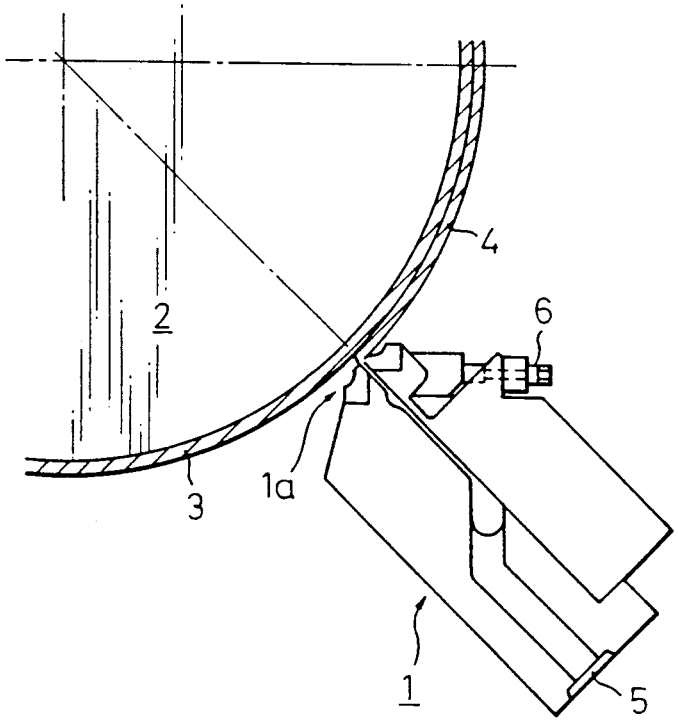
FIG. 1 shows a side view of an embodiment of an apparatus for coating a coating liquid for forming an undercoat layer in accordance with the process of the present invention.

It is well known that air bubbles are generated when an undercoat layer-forming coating liquid is coated on a covering resin layer, and that these air bubbles cause a coating unevenness of the resultant undercoat layer and have an adverse influence on the photographic characteristics and coating evenness of a photographic emulsion layer coated on the undercoat layer. The present inventors found that these air bubbles are generated by a circulation of the coating liquid, and carried out research with a view to solving this problem.

Referring to FIG. 1, in the formation of an undercoat layer from a coating liquid, a coater 1 having slit-shaped orifice 1*a* is used. The coating liquid is fed from a coating liquid supply inlet 5 and extruded through the slit-shaped orifice 1*a*, and all or substantially all of the extruded coating liquid is coated and laminated on the surface of a sheet 3 to be coated, while the sheet 3 is rotated and travelled at a constant speed together with a rotating backing roll 2, to form a coating liquid layer 4. Namely, according to the process of the present invention, circulation of the coating liquid is unnecessary, and thus the above-mentioned objects of the present invention can be obtained. The slit width of the slit-shaped orifice 1*a* can be adjusted to a desired value by an adjustment screw 6.

In the process of the present invention, the top end of the slit-shaped orifice does not come into direct contact with the coating liquid layer applied to the substrate sheet, and accordingly, the formation of uneven coating liquid layer having the fine streaks usually formed when the coating liquid is coated by using a bar coater, blade coater or comma coater while applying a high shearing force to the coating liquid, can be prevented. Also, the generation of an uneven coating liquid layer in a specific pattern usually formed when a coating roller of gravure coater is separated from the surface of the material to be coated, can be prevented.

Furthermore, the formation of an uneven coating liquid layer in a specific pattern usually formed when a coating liquid is applied by using an air knife coater and an excessive amount of the coating liquid is blown off by the air knife coater, cannot occur, and there is no risk of a generation of a mist of the blown-off coating liquid.

A completely closed system can be established in the apparatus for use in carrying out the process of the present invention, and there is no risk of an incorporation of contaminants in the air in the undercoat forming coating liquid or the undercoat layer, and thus no risk of an inclusion of bacteria therein. Moreover, since the coating liquid or undercoat layer does not come into contact with the air, no propagation of aerobic bacteria occurs.

Since air bubbles are not incorporated in the coating liquid, an anti-foaming agent need not be added, and since an anti-foaming agent is not used, the problems caused by the use of the anti-foaming agent, such as a repelling of the liquid and a poor coating of the emulsion, can be completely solved.

As apparent from the foregoing description, the process of the present invention is most preferable in all points as a process for the preparation of a support for a photographic printing paper having an undercoat layer.

The coating apparatus usable for the present invention is a coating liquid-extruding type coater having a slit-shaped orifice, and preferably the width of the slit-shaped orifice is adjustable over the entire length of the orifice, and the dry thickness of the coating layer can be adjusted while maintaining the thickness uniformity.

Also, preferably the distance between the top end of the orifice and the surface of the substrate sheet to be coated is variable while the substrate sheet is forwarded.

The coating liquid is supplied from a service tank in a closed system or open system by a liquid feed pump while strictly controlling the extrusion rate thereof. Preferably, the coating apparatus has a structure such that the entire apparatus can be maintained at a predetermined temperature.

A substrate sheet usable for the present invention usually consists of a paper sheet which can be selected from those usable as substrates for photographic printing paper sheets. For example, natural pulp paper sheet, synthetic pulp paper sheets, natural pulp/synthetic pulp mixed paper sheets, and various composite paper sheets, can be used for the substrate sheet. Additives customarily used in this field, for example, a sizing agent, a fixing agent, a strength improver, a filler, an antistatic agent, a pH adjusting agent, a pigment and a dye, can be contained in the substrate sheet. Moreover, a surface sizing agent, a surface strength improver, and an antistatic agent can be coated on the surface of the substrate sheet.

Various sythetic paper sheets and films also can be used as the substrate sheet. Moreover, a substrate sheet coated with an electron beam-curable resin or a composite sheet obtained by coating a surface of a sheet with an electron beam-curable resin and melt-extrusion coating, an opposite surface of the sheet with a polyolefin resin can be used for the support sheet of the present invention.

A polyolefin resin coating layer is formed on two surfaces of the sheet-like substrate. The polyolefin resin usable for the polyolefin resin coating layer is selected from homopolymers of $\alpha$-olefins such as polyethylene and polypropylene, copolymers of two or more of the $\alpha$-olefins, and mixtures of these polymers. Low-density polyethylene, high-density polyethylene, and mixtures thereof, are especially preferable as the polyolefin resin for the present invention.

Additives such as white pigments, colored pigments, fluorescent brightening agents, antioxidants, and dispersing agents can be added to the polyolefin resin. In the process of the present invention, an additive as mentioned above may be contained in the polyolefin resin coating layer formed on the front surface of the substrate sheet on which the photographic emulsion is to be coated.

In the process of the present invention, the activation treatment to be effected on the resin coating layer before formation of the undercoat layer is appropriately selected from among a known corona discharge treatment, flame treatment, activating chemical treatment, and cold plasma treatment.

The undercoat layer is formed on the surface activated resin coating layer.

The kind of gelatin used in the process of the present invention is not particularly critical, unless the gelatin affects the photographic emulsion layer to be formed on the gelatin undercoat layer. For example, gelatin extracted from the bone and gelatin extracted from the skin can be used, and the method of extracting the gelatin may be selected from the acid methods and the alkali methods. The physical properties of gelatin are not particularly critical. For example, the jelly strength may be at a level customarily adopted for the undercoat layer, and the viscosity of the gelatin also may be at a level customarily adopted for the undercoat layer.

The undercoat layer of the present invention comprises gelatin as the main component and may include additives such as a hardener, a surface activator, a thickener, a white pigment, a matting agent, an antistatic agent, and an anti-fogging agent, according to need. The hardener usable for a formation of the undercoat layer of the present invention can be selected from inorganic hardeners, for example, chromium alum, and organic hardeners, for example, an aldehyde type hardeners, N-methylol and acetal hardeners, epoxy hardeners, aziridine hardeners, mucohalogenic acid hardeners, active halogen hardeners, dichloro-S-triazine hardeners, active olefin hardeners, isoxazolium hardeners, methane-sulfonic acid ester hardeners, and active ester hardeners.

The surface activator agent usable for the undercoat-forming coating liquid may be selected from natural substances, for example, saponin, and sythetic activators, for example, anionic activators, such as higher fatty acid alkali metal salts, alkyl sulfate salts and sulfosuccinic acid esters, cationic activators such as higher amine halogenic acid salts, alkyl pyridinum halides and quaternary ammonium salts, nonionic activators such as polyethylene glycol alkyl ethers and polyethylene glycol fatty acid esters, and amphoteric activators such as amino acids.

The thickener usable for the undercoat forming coating liquid, can be selected from natural substances such as casein, starch and natural gum, cellulose derivatives such as carboxymethylcellulose, and water-soluble polymers such as polyvinyl alcohol.

The white pigment usable for the undercoat-forming coating liquid, can be selected from titanium dioxide, barium sulfate, calcium sulfate, barium carbonate, calcium carbonate, aluminum white, zinc oxide, silica white, antimony trioxide and titanium phosphate.

In the process of the present invention, the undercoat layer may be subjected to a low-temperature coagulation treatment during the period of from the step of the coating of the undercoat-forming coating liquid to the step of drying, although this treatment is not absolutely necessary. Furthermore, the dry weight of the undercoat layer is preferably less than 0.1 $g/m^2$, and the surface of the undercoat layer formed by coating and drying according to the above-mentioned procedures can be subjected to an activation treatment, for example, a corona discharge treatment.

EXAMPLES

The present invention will now be described in detail with reference to the following examples and comparative examples, that by no means limit the scope of the invention.

In the examples and comparative examples, the following measurements were carried out when evaluating the products.

Evaluation of Coating Liquids

Antifoaming property of Coating Liquids

In view of the principle of the slit orifice coater used in the examples of the process of the present invention, the coating liquid is not circulated and thus air foaming does occur and bubbles are not incorporated or formed. In the Meyer bar coating method used in the comparative examples, the degree of anti-foaming property of the coating liquid was evaluated by naked eye observation of the quantity of air foaming generated on the surface of a color pan, and the evaluation results are indicated as follows:

3: no foaming
2: slight foaming
1: conspicuous foaming

Antirepelling property of coating liquid

The antirepelling property of the undercoat-forming coating liquid when coated on the surface of the substrate sheet to form an undercoat layer was evaluated in the following manner.

After the coating liquid was coated and dried, the resultant undercoat layer was dyed with a Methylene Blue dyeing solution, and the number of non-dyed portions (holes) per $m^2$ was counted. The results are indicated as follows:

3: 0 hole per $m^2$
2: 1 to 5 holes per $m^2$
1: at least 6 holes per $m^2$

Putrefaction of Coating Liquids

The degree of putrefaction of the coating liquid was judged based on the number of living bacteria generated in the coating liquid with the lapse of time. In this evaluation method, in the state in which the coating liquid was coated, i.e., in the closed state when the slit orifice coater was used or in the state circulated in air when the Meyer bar coater was used, the coating liquid was allowed to stand at 38° C. for 24 hours, and the number of living bacteria propagated in the coating liquid was counted.

The count of the number of living bacteria was conducted by the plate culture counting method (see, for example, Experimental Agricultural and Horticultural Chemistry, Volume 2, page 205, Asakura Shoten). According to this method, the coating liquid was sampled and diluted while checking the degree of dilution, the diluted coating liquid was scattered on a plate culture medium (agar culture medium), and a stationary culturing was conducted at 28° C. for 3 days in this plate culture medium. The number of colonies formed on the plate culture medium was then counted, and the number of living bacteria in the coating liquid was calculated.

If the number of living bacteria exceeds $1\times10^8$ per ml, the coating liquid is putrefied. Accordingly, if the number of living bacteria in the coating liquid is smaller than $1.0\times10^7$ per ml, preferably smaller than $2.0\times10^6$ per ml, the coating liquid is not putrefied. Note, the initial number of living bacteria was $3.5\times10^5$ per ml.

Evaluation of Coating Layers

Surface smoothness of Coating Layers

The dried undercoat layer was dyed with a Methylene Blue dyeing solution, and the presence or absence of fine streaks on the coating was organoleptically checked by naked eye observation. The results are indicated as follows:

2: no streaks found (smooth)
1: streaks found (not smooth)

Wettability

The wettability of the surface of the undercoat layer was evaluated by measuring the wet index (dyne/cm) thereof, using a wet index standard solution (made by Wako Junyaku), according to JIS K-6768. This wettability indicates the coating property of the undercoat layer when a photographic emulsion layer is formed thereon. The wettability was evaluated twice; just after the formation of the undercoat layer on the substrate sheet and after aging the resultant support sheet at a temperature of 40° C. and at a relative humidity of 50% for 3 days.

The results are indicated as follows:

3: good
2: not good
1: poor

Evaluation of Coating Property of Photographic Emulsion Layer

To determine the adhering property of the photographic emulsion to the support sheet and the coating-initiating line, the formation of a photographic paper sheet (coating of a photographic emulsion) was carried out in the following manner. Namely, the surface of the undercoat layer of the support sheet was first subjected to a corona discharge treatment. Then photographic emulsion was prepared by mixing, at a temperature of 40° C., a silver salt emulsion (commercially available under the trademark of Liquid Light, from Rockland Colloid Co., U.S.A.) with a hardener (available under the trademark of Hardener HDU from Sogo Yakuko Co.) comprising N,N'-hexamethylene-1,6-bis (1-aziridinecarboxamide, in an amount of 0.8 g per 100 g of the silver salt emulsion, and the emulsion was coated in a dry weight of 10 g/$m^2$ on the surface of the undercoat layer by a bead coating method. The resultant emulsion layer was dried at a temperature of 50° C.

Coating-Initiating Line

The term "coating-initiating line" refers to a distance between the line on which the photographic emulsion comes into first contact with the support sheet surface and the line on which the emulsion can be completely uniformly coated on the support sheet. The largest distance was measured and recorded. The shorter the distance, the higher the affinity of the photographic emulsion to the undercoat layer. In practical use, the coating-initiating line should be 10 mm or less.

Adhering property

The wet adhering property of the photographic emulsion of the photographic paper sheet to the undercoat layer of the support sheet was determined in the following manner. Namely, the photographic paper sheet was immersed in a CNP-CD developer solution (supplied by LPL) for a color photographic paper at a temperature of 35° C. for 2 minutes and crossing scratches were formed on the photographic surface portion of the photographic paper sheet in the developer solution by a knife. The cross-scratched portions were rubbed by the ball of the thumb 10 times, the amount of peeling of the photographic emulsion layer was examined, and the adhering property of the photographic emulsion layer to the support sheet was organoleptically evaluated as follows:

3: good adhesion
2: not good adhesion
1: poor adhesion

This evaluation was carried out twice; just after coating the support sheet with the photographic emulsion and after aging the resultant photographic paper sheet at a temperature of 40° C. and at a relative humidity of 50% for 3 days.

EXAMPLE 1

A polyethylene resin containing 10% by weight of titanium dioxide was extrusion-coated in a thickness of 30 μm on the front surface of a substrate sheet consisting of a natural pulp paper sheet and having a base weight of 175 g/m$^2$, and a polyethylene resin was extrusion coated in a thickness of 30 μm on the back surface of the substrate sheet to form a polyethylene-covered paper sheet. Immediately after the coating operation, the surface of the front polyethylene resin coating layer containing titanium dioxide was subjected to the corona discharge treatment.

Using the slit orifice coater, a coating liquid having a composition described below was extrusion-coated on the corona-discharge-treated front surface of the polyethylene-resin coated paper sheet traveling at a speed of 100 ml/min while controlling the extrusion rate so that the weight of the resulting coating layer after drying become 0.007 g/m$^2$.

Composition of Undercoat Layer-Forming Coating Liquid

| | |
|---|---|
| 0.1% Aqueous solution of gelatin | 1000 parts |
| Aziridine type hardener (Trademark: HDU, supplied by Sogo Yakuko) | 6.5% based on the weight of gelatin |
| Alkyl sulfate salt type activator (Trademark: Emal E27C, supplied by Kao) | 1 part |

The resultant coating liquid layer was dried at 120° C. without cooling and setting, to form an undercoat layer and obtain a support sheet for photographic printing paper.

In the used slit orifice, the slit width was adjusted to 40 μm upon average, and fine adjustments carried out so that the thickness of the coating layer after drying became uniform. The distance between the top end of the orifice and the surface of the traveling polyethylene resin coated paper sheet to be coated was adjusted to 15 μm.

The evaluation tests of the coating liquid, the coating layer and the photographic emulsion-coating property were carried out as described hereinbefore. The results are shown in Table 1.

EXAMPLE 2

The same procedures as in Example 1 were carried out except that the gelatin concentration in the undercoat layer-forming coating liquid was changed to 0 5% and the weight of the resultant undercoat layer after drying was changed to 0.025 g/m$^2$. The evaluation test results are shown in Table 1.

COMPARATIVE EXAMPLE 1

The same procedures as in Example 1 were carried out except that, when the coating liquid was circulated, a Meyer bar coater was used as the undercoat layer forming coater. The evaluation test results are shown in Table 1.

COMPARATIVE EXAMPLE 2

The same procedures as in Example 1 were carried out except that 200 ppm of a silicone type anti-foaming agent (Trademark: FS Antifoam 92, supplied by Dow Corning Co.) was added to the undercoat layer-forming coating liquid, and where the coating liquid was circulated, a Meyer bar coater was used as the undercoat layer-forming coater. The evaluation test results are shown in Table 1.

COMPARATIVE EXAMPLE 3

The same polyethylene-resin coated paper sheet as used in Example 1 was subjected to the corona discharge treatment without forming an undercoat layer. The results of the evaluation tests of the treated paper sheet are shown in Table 1.

As clearly indicated in Table 1, in the support sheet of the present invention for photographic printing paper, no unevenness of the undercoat layer due to foaming of the undercoat layer-forming coating liquid was observed. The adhering strength between the undercoat layer and the photographic emulsion layer formed directly thereon is the same as the adhering strengthen obtained by a usual surface-activating treatment such as a corona discharge treatment, and this high adhering strength is not lowered even after a lapse of time. The wet index of the surface of the undercoat layer, which will influence the coating effect of a photographic emulsion, is much improved when compared with the wet index of the surface of the conventional support sheet subjected to the corona discharge treatment without forming the undercoat layer of the present invention. Moreover, in the support sheet prepared by the process of the present invention, since the resultant undercoat layer has an excellent coating uniformity, an increased thickness of the emulsion layer at the start of the coating operation of the emulsion or in the vicinity of the coating-initiating point, or disruption of the coating initiating line, such as tailing due to an insufficient coating of the emulsion, does not occur. Accordingly, the support sheet of the present invention is extremely useful for preparing a high-quality photographic printing paper.

TABLE 1

| Coating liquid for undercoat layer | |
|---|---|
| | Degree of putrefaction |

TABLE 1-continued

| Item Example No. | Coater for under-coat layer | Amount of antifoaming agent | Anti-foaming property | Anti-repelling property | (Number of living bacteria per ml) | Undercoat layer Surface smooth-ness | Undercoat layer Amount ($g/m^2$) |
|---|---|---|---|---|---|---|---|
| Example | | | | | | | |
| 1 | Slit-shaped orifice coater | None | 3 | 3 | $1.5 \times 10^6$ | 2 | 0.007 |
| 2 | Slit-shaped orifice coater | None | 3 | 3 | $6.7 \times 10^5$ | 2 | 0.025 |
| Comparative Example | | | | | | | |
| 1 | Meyer bar coater | None | 1 | 2 | $>1.0 \times 10^8$ | 1 | 0.006 |
| 2 | Meyer bar coater | 200 ppm | 2 | 1 | $>1.0 \times 10^8$ | 1 | 0.007 |
| 3 | — | — | — | — | — | — | — |

| Item Example No. | Surface wettability (dyne/cm) Immediately after coating | Surface wettability (dyne/cm) After standing at 40° C. and 50% RH for 3 days | Photographic emulsion coating step: Wet adhering property Immediately after coating of of under-coat | Photographic emulsion coating step: Wet adhering property After standing of undercoat layer at 40° C. and 50% RH for 3 days | Coating initiating line (mm) |
|---|---|---|---|---|---|
| Example | | | | | |
| 1 | 60 | 60 | 3 | 3 | 4 |
| 2 | 60 | 60 | 3 | 3 | 6 |
| Comparative Example | | | | | |
| 1 | 60 | 60 | 3 | 3 | 7 |
| 2 | 60 | 60 | 3 | 3 | 18 |
| 3 | 48 | 34 | 3 | 1 | 4 |

We claim:

1. A process for the preparation of a support sheet for photographic printing sheet material, comprising the steps of:

a. coating each of front and back surfaces of a substrate sheet with a resinous material comprising, as a principal component, a polyolefin resin;

b. subjectng the polyolefin-coated front surface of the substrate to a surface-activation treatment; and c. then forming a hydrophilic layer for binding to a photographic emulsion coating to be applied thereover, by coating the activated polyolefin-coated front surface of the substrate sheet with a coating liquid by extruding the coating liquid through a slit-shaped orifice, said coating liquid consisting of an aqueous solution of gelatin and an additive consisting of at least one member selected from the group consisting of hardeners, surface-activators, thickeners, white pigments, matting agents, antistatic agents, and anti-fogging agents; and then drying the resultant coating liquid layer on the activated front coating resin layer, to form a dried gelatin-containing layer having a weight of 0.007 $g/m^2$ or more but less than 0.1 $g/m^2$.

2. The process as claimed in claim 1, wherein the substrate sheet consists of a paper sheet.

3. A process for the preparation of a support sheet for photographic printing paper comprising preparing the support sheet by a process according to claim 2 wherein the coating liquid is free of anti-foaming agents and is applied to the activated polyolefin-coated front surface of the substrate sheet and then dried in the substantial absence of bacterially contaminated air to form a smooth gelatin-containing layer of improved antirepelling property, surface wettability, wettability retention, and coating affinity and adherence retention to a photographic emulsion coating to be applied thereover as compared to a similar support sheet provided with a gelatin-containing layer containing an anti-foaming agent or to a support sheet having an activated polyolefin-coated substrate sheet surface with no gelatin-containing layer.

4. A support sheet prepared according to the process of claim 3.

5. A sheet of photographic printing paper comprising a support sheet made according to claim 4, and a coating of photographic emulsion overlying and bonded to the gelatin-containing layer of the support sheet.

6. The process as claimed in claim 1, wherein the polyolefin resin comprises at least one member selected from the group consisting of polyethylene resins, polypropylene polyolefin resins, ethylene-propylene copolymers, and mixtures of two or more of the above-mentioned resins.

7. The process as claimed in claim 1, wherein the surface-activation treatment is selected from the group consisting of a corona discharge treatment, flame treatment, activating chemical treatment, and cold plasma treatment.

8. A process according to claim 1, wherein application of the coating liquid is carried out without deaeration thereof.

9. A process according to claim 1, comprising the additional step of substantially excluding exposure of the coating liquid to biologically contaminated air, thereby reducing biological contamination of the gelatin-containing layer and improving the smoothness of such layer and the storage stability of the support sheet.

10. A support sheet made by a process according to claim 9, wherein the gelatin-containing layer has improved resistance to bacterial putrefaction as compared to a similar sheet wherein the coating liquid is applied without substantially excluding exposure of the coating liquid to biologically contaminated air.

11. A process according to claim 1, comprising the additional step of adjusting the width of the slit-shaped extrusion orifice, thereby providing more uniform thickness of the extruded gelatin-containing layer.

12. A process according to claim 11, comprising the additional step of varying the distance between the slit-shaped extrusion orifice and the polyolefin-coated front surface of the substrate sheet to which the coating liquid is applied, thereby providing further thickness uniformity of the extruded gelatin-containing layer.

13. A support sheet for photographic printing sheet material made by a process according to claim 1, wherein the support sheet surface to which a coating of photographic emulsion is to be applied has improved smoothness, antirepelling property, surface wettability, wettability retention, and emulsion coating affinity and adherence retention as compared to a similar support sheet having a bar-coated binding layer containing an anti-foaming agent.

14. A sheet of photographic printing sheet material comprising a support sheet according to claim 13 and a photographic emulsion coating overlying the gelatin-containing layer and having improved retention of adherence to the support sheet as compared to a similar article having an activated polyolefin-coated front substrate sheet surface with no binding layer.

15. A process for the preparation of photographic printing sheet material comprising preparing a support sheet by a process according to claim 1, subjecting the dried layer to a surface activation treatment, and then applying a photographic emulsion coating to the activated layer.

16. A sheet of photographic printing sheet material made in accordance with the process of claim 15.

* * * * *